US006180859B1

(12) United States Patent
Konishi

(10) Patent No.: US 6,180,859 B1
(45) Date of Patent: Jan. 30, 2001

(54) PANEL ASSEMBLY FOR ELECTRONIC KEYBOARD MUSICAL INSTRUMENT

(75) Inventor: Keiji Konishi, Shizuoka-ken (JP)

(73) Assignee: Kabushiki Kaisha Kawai Gakki, Shizouki-Ken (JP)

( * ) Notice: Under 35 U.S.C. 154(b), the term of this patent shall be extended for 0 days.

(21) Appl. No.: 09/407,982

(22) Filed: Sep. 29, 1999

(30) Foreign Application Priority Data

Sep. 30, 1998 (JP) ..... 10-278218
Sep. 30, 1998 (JP) ..... 10-278219

(51) Int. Cl.[7] ..... G10C 1/00

(52) U.S. Cl. ..... 84/174; 84/177; 84/423 R; 84/108; 84/438; 403/408.1

(58) Field of Search ..... 84/423 R, 432, 84/438, 174–177, 108; 312/223.1, 223.2, 265.5, 263, 264; 403/408.1, 258, 260

(56) References Cited

U.S. PATENT DOCUMENTS 5,353,675 * 10/1994 Kimura et al. ..... 84/423 R
5,460,564 * 10/1995 Bowes et al. ..... 451/89
5,838,540 * 11/1998 Wen-Shyong ..... 361/686
5,907,115 * 5/1999 Matsunaga et al. ..... 84/477 R

* cited by examiner

*Primary Examiner*—Karen Masih
*Assistant Examiner*—Shih-yung Hsieh
(74) *Attorney, Agent, or Firm*—Arent Fox Kintner Plotkin & Kahn, PLLC

(57) ABSTRACT

A panel assembly for an electronic keyboard musical instrument is disposed over a substantially entire width in a direction in which keys are arranged. The panel assembly serves to cover electronic circuits or the like contained therein. The panel assembly is made up of two members of a front panel and a rear panel which are divided in the direction in which the keys are arranged. A rear end portion of the front panel is placed on top of a front end portion of the rear panel, and the front panel and the rear panel are connected together by self tapping screws to be screwed from a lower side into the lower surface of the rear end portion of the front panel.

8 Claims, 3 Drawing Sheets

PANEL ASSEMBLY FOR ELECTRONIC KEYBOARD MUSICAL INSTRUMENT

BACKGROUND OF THE INVENTION

1. Field of the Invention

The present invention relates to a panel assembly for an electronic keyboard musical instrument. The panel assembly is disposed over a substantially entire width in a direction in which keys are arranged (i.e., in the right and left direction of a keyboard) to thereby cover electronic circuits or the like contained inside the electronic keyboard musical instrument.

2. Description of the Related Art

Conventionally, a panel for use in an electronic keyboard musical instrument is ordinarily formed in the following shape. Namely, it extends from the back of a keyboard at an upward inclination toward the rear of the electronic keyboard musical instrument, and thereafter forms a horizontal portion. It further extends substantially vertically downward to thereby form a rear wall of the electronic keyboard musical instrument. The panel covers electronic circuits and mechanisms such as an action (i.e., a mechanism to operatively function the keys), or the like of the electronic keyboard musical instrument. In this manner, the electronic circuits or the like are prevented from being exposed to the outside. Further, in that inclined portion of the panel which extends from the back of the keyboard at an upward inclination, there are disposed switches such as for varying the tone and indicators such as light-emitting diodes (LED's) or the like. This kind of panel must be provided with the inclined portion, the horizontal portion, and the rear wall portion in the back and forth direction (i.e., in a direction perpendicular to the direction in which the keys are arranged). Therefore, the shape of the panel varies in a complex manner in this direction. On the other hand, the shape of the panel in the right and left direction (i.e., in the direction in which the keys are arranged) does not vary but remains constant. Therefore, the panel is integrally formed as a single piece of member by using an extruded material which is formed by extruding a metallic material such as aluminum or the like in the right and left direction of the keyboard.

However, when the electronic circuits become complicated and large in size, or when the action in the keyboard become large in size, the width of the electronic keyboard musical instrument in the back and forth direction becomes large. It follows that the width of the panel in the back and forth direction, i.e., in the direction perpendicular to the one in which the panel is extruded, becomes large. If the above-described width of panel becomes large, metallic dies for use in extruding process also become large in size and expensive. In addition, the extruding force must be increased. As a result, a large size of extruding apparatus must be used. Further, in case the panel is subjected to surface treatment for a decorative purpose, the surface treatment of the front portion of the panel is sometimes made different from that of the rear portion thereof. If such different surface treatments are made on the integrally formed single piece of panel, that portion of the panel which is not subjected to surface treatment must be covered by a masking material to prevent it from being surface-treated. Another masking must also be made on the already surface-treated portion when the remaining portion is surface-treated. In this manner, the surface treatments take a lot of working steps and manpower.

SUMMARY OF THE INVENTION

In order to solve the above-described problems associated with the prior art, the present invention is a panel assembly for an electronic keyboard musical instrument, which panel assembly is disposed over a substantially entire width in a direction in which keys are arranged and which panel assembly serves to cover therewith electronic circuits or the like contained therein. The panel assembly is made up of two members of a front panel and a rear panel which are divided in the direction in which the keys are arranged.

By making the panel assembly of the electronic keyboard musical instrument by two members of the front panel and the rear panel, the width of extrusion of each of the members constituting the panel assembly becomes smaller than the width of extrusion of a panel made of an integrally formed single piece of member. Therefore, the panel assembly according to the present invention can be formed with a smaller size of extruding apparatus.

Preferably, a rear end portion of the front panel is placed on top of a front end portion of the rear panel, and the front panel and the rear panel are connected together by screw means to be screwed from a lower side into a lower surface of the rear end portion of the front panel. By employing the above-described construction of connecting the two members, the connected portion of the two members is less visible to the eye from the front side of the electronic keyboard musical instrument.

In case the two members are connected in this manner, it is considered to employ the following construction. Namely, when the front panel is formed by extrusion, projections which are U-shaped in cross-section are formed on the lower surface of the rear end portion of the front panel, with the U shape opening in a direction away from the lower surface. Openings are formed in the front end portion of the rear panel and a self tapping screw is inserted from the lower side into each of the openings. By screwing the self tapping screw into the recess of the U shape of each of the projections, the front panel and the rear panel are connected together. If the front panel and the rear panel are connected together in this manner, the projections remain interposed between the front end portion of the rear panel and the rear end portion of the front panel. As a result, the distance between the rear end portion of the front panel and the front end portion of the rear panel becomes large, and the thickness of the connected portion becomes large. Then, the front end portion of the rear panel must be inserted deep enough into a region in which the printed circuit boards are disposed, whereby the freedom in the design of the electronic keyboard musical instrument is largely limited.

As a solution to this problem, preferably, the front panel further comprises bosses which project from a lower surface of the rear end portion of the front panel, and the rear panel has at a front end portion thereof openings for receiving therein the bosses. The front panel and the rear panel are connected together by inserting screw means into the bosses in a state in which the bosses are inserted into the respective openings. By thus inserting the bosses into the openings, the rear end portion of the front panel comes into close contact with the front end portion of the rear panel and, therefore, the thickness of the connected portion of the front panel and the rear panel becomes small.

Further, preferably, at least one of the front panel and the rear panel is subjected to a surface treatment before both the panels are connected together. By employing this arrangement, it is not necessary to mask the other panel and, as a consequence, the steps and manpower required for the surface treatments can be reduced.

BRIEF DESCRIPTION OF THE DRAWINGS

The attendant advantages of the present invention will become readily apparent by reference to the following detailed description when considered in conjunction with the accompanying drawings wherein.

DETAILED DESCRIPTION OF A PREFERRED EMBODIMENT

Figure 1:
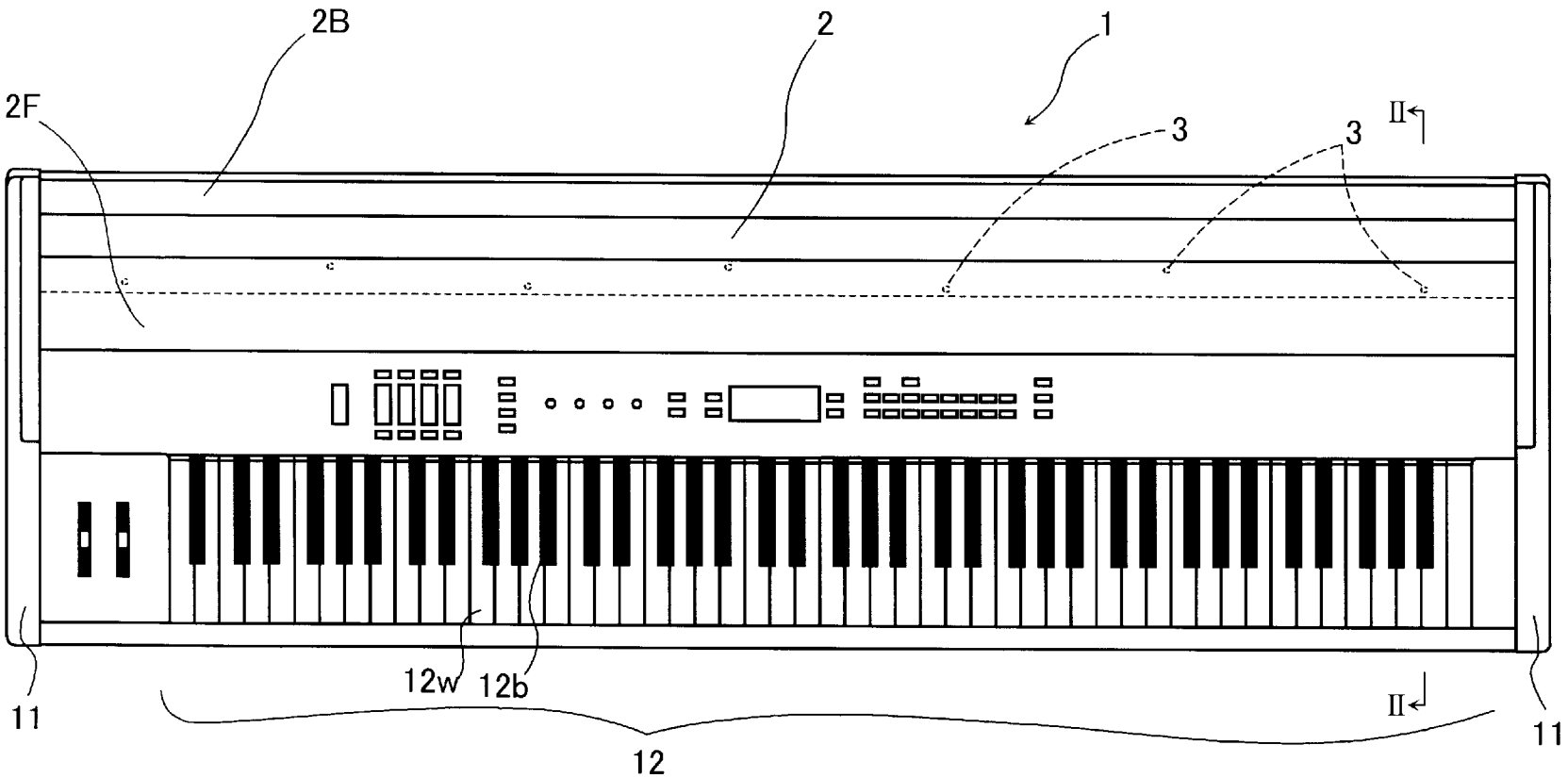
FIG. 1 is a plan view of an electronic keyboard musical instrument according to the present invention.

With reference to FIG. 1, reference numeral 1 denotes an electronic keyboard musical instrument. It has an arm 11 on right side and left side, respectively. Between the arms 11, 11 there is disposed a keyboard 12 which is made up of a predetermined number of white keys 12W and black keys (chromatic keys) 12*b*, respectively. Inside the electronic keyboard musical instrument 1, electronic circuits or the like (not illustrated) are contained behind the keyboard 12. A panel assembly 2 which covers these electronic circuits or the like is provided. This panel assembly 2 is made up of two members which are divided in the back and forth direction. Here, the back and forth direction means a direction perpendicular to the direction in which the keys are arranged. In other words, the two members are divided along a line parallel with the direction in which the keys are arranged. Namely, the panel assembly 2 is made up of a front panel 2F on which various switches, indicators or the like are mounted and a rear panel 2B which is connected to the rear of the front panel 2F. The front panel 2F and the rear panel 2B are made of extruded aluminum plates which are formed by extruding aluminum raw material in the right and left direction as seen in FIG. 1 (i.e., in the direction in which the keys are arranged).

Figure 2:
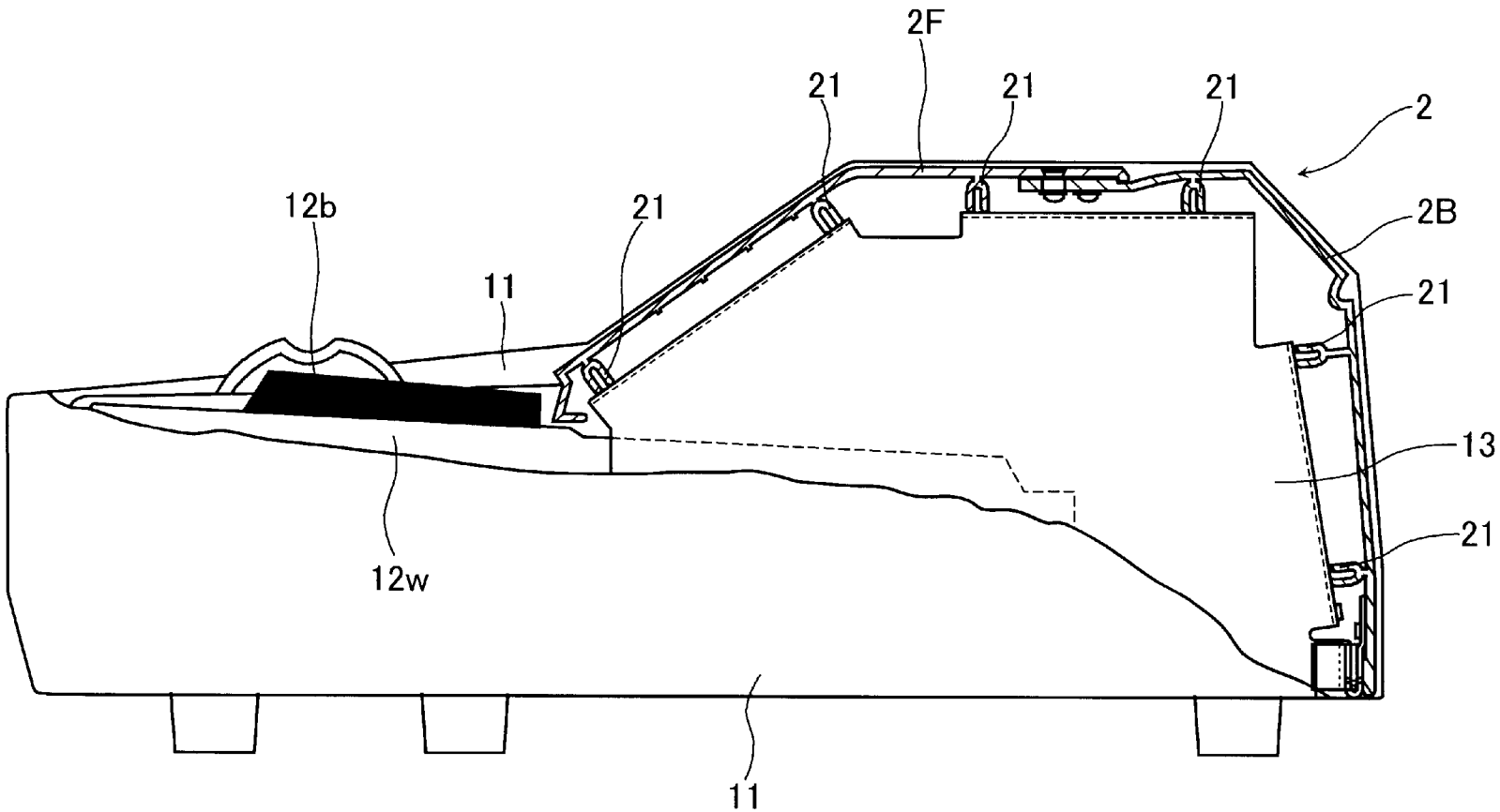
FIG. 2 is a side view thereof, partly shown in section, taken along the line II—II in FIG. 1.
Figure 3:
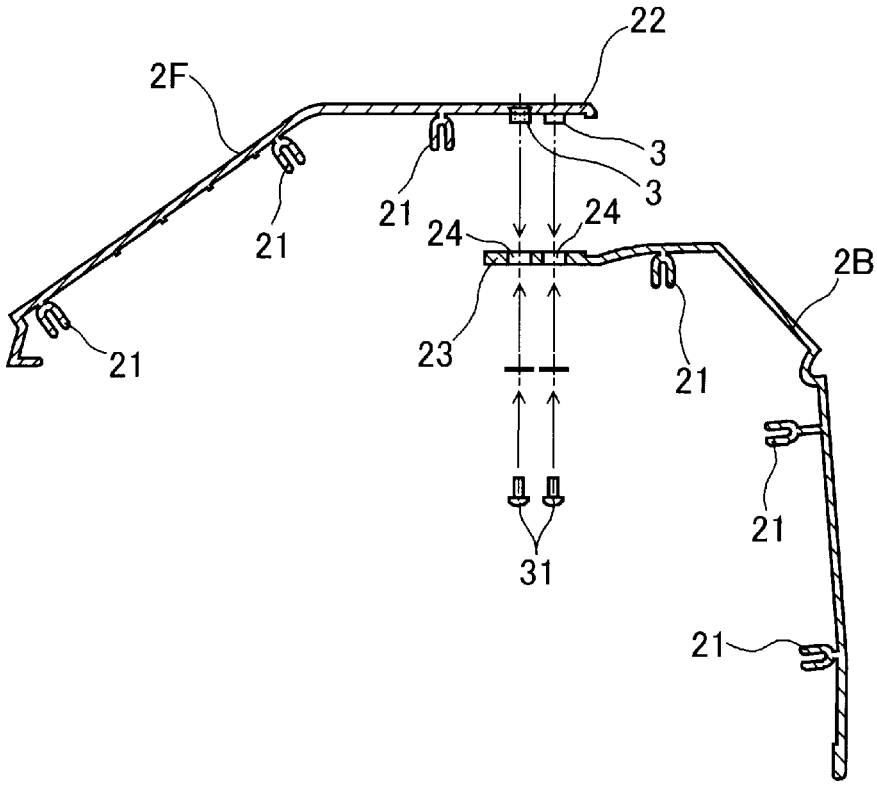
FIG. 3 is an exploded view to show the panel assembly in a state in which it is divided into a front panel and a rear panel.
Figure 4:
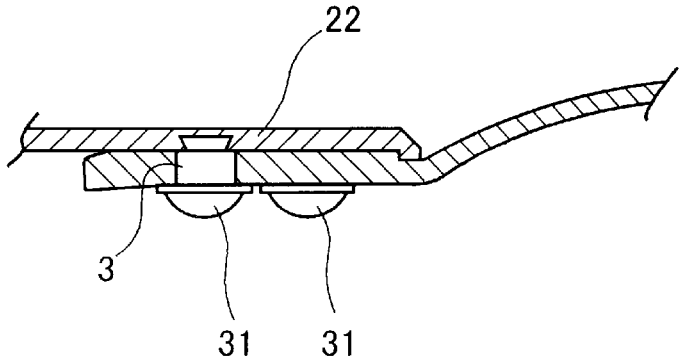
FIG. 4 is a sectional view showing the details of the connected portion.

As shown in FIG. 2, the electronic keyboard musical instrument 1 is provided with a cover 13 which is made of a metallic plate and which covers the above-described electronic circuits or the like. The inner surrounding surfaces of the front panel 2F and the rear panel 2B are provided with leg portions 21 which function to keep the panel assembly 2 in position relative to the cover 13 by causing the legs 21 to come into contact with an outer surrounding surface of the cover 13. The leg portions 21 are U-shaped in cross-section, as illustrated in FIGS. 2 and 3, and are continuously formed in the right and left direction because the two members are formed by the manufacturing process of extrusion. As shown in FIGS. 3 and 4, nut members 3 which are also defined as bosses are cast into, and retained to, the lower or inner surface in the rear end portion 22 of the front panel 2F. On the other hand, openings 24 for fitting the nut members 3 thereinto are formed through the front end portion 23 of the rear panel 2B. It is thus so arranged that the nut members 3 are inserted into the respective openings when the rear end portion 22 of the front panel 2F is placed on top of the front end portion 23 of the rear panel 2B. The height of projection of each of the nut members 3 is set so as to be slightly smaller than the thickness of the front end portion 23 of the rear panel 2B. By screwing a screw 31 via a washer into each of the nut members 3 in a state in which the nut members 3 are inserted into the respective openings 24, the front panel 2F and the rear panel 2B can be firmly tied or connected together.

The front panel 2F and the rear panel 2B are subjected to respective surface treatments before they are connected together. The surface treatment may be appropriately selected from an aesthetic or design viewpoint. For example, the front panel 2F is subjected to a surface treatment of delustering by shot blasting or of a brushed aluminum finish, and the rear panel 2B is subject in advance to painting for delustering.

In the embodiment shown in FIGS. 2 through 4, the nut members 3 are fixed in two rows of a front row and a rear row. They are, as shown in FIG. 1, arranged in a staggered manner such that the front row of nut members 3 and the rear row of nut members 3 are alternately positioned as seen in the right and left direction.

It is readily apparent that the above-described panel assembly for an electronic keyboard musical instrument has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. The panel assembly for an electronic keyboard musical instrument, said panel assembly being disposed over a substantially entire width in a direction in which keys are arranged, said panel assembly serving to cover therewith components contained therein, wherein said panel assembly is made up of two members of a front panel and a rear panel which are divided in the direction in which the keys are arranged, wherein a rear end portion of said front panel is placed on top of a front end portion of said rear panel, said front panel and said rear panel being connected together by screw means to be screwed from a lower side into a lower surface of and only partially through the rear end portion of said front panel.

2. The panel assembly according to claim 1, wherein said front panel further comprises bosses which project from the lower surface of the rear end portion of said front panel, and wherein said rear panel has at a front end portion thereof openings for receiving therein said bosses, said front panel and said rear panel being connected together by inserting screw means into said bosses in a state in which said bosses are inserted into said respective openings.

3. The panel assembly according to claim 2, wherein at least one of said front panel and said rear panel is subjected to a surface treatment before both said panels are connected together.

4. The panel assembly according to claim 1, wherein at least one of said front panel and said rear panel is subjected to a surface treatment before both said panels are connected together.

5. The panel assembly according to claim 1, wherein said front panel has mounted thereon switches and indicators.

6. The panel assembly for an electronic keyboard musical instrument, said panel assembly being disposed over a substantially entire width in a direction in which keys are arranged, said panel assembly serving to cover therewith components contained therein, wherein said panel assembly is made up of two members of a front panel and a rear panel which are divided in the direction in which the keys are arranged, wherein said front panel further comprises bosses which project from a lower surface of the rear end portion of said front panel, and wherein said rear panel has at a front end portion thereof openings for receiving therein said bosses, said front panel and said rear panel being connected together by inserting screw means into said bosses in a state in which said bosses are inserted into said respective openings.

7. The panel assembly according to claim 6, wherein at least one of said front panel and said rear panel is subjected to a surface treatment before both said panels are connected together.

8. The panel assembly for an electronic keyboard musical instrument, said panel assembly being disposed over a substantially entire width in a direction in which keys are arranged, said panel assembly serving to cover therewith components contained therein, wherein said panel assembly is made up of two members of a front panel and a rear panel which are divided in the direction in which the keys are arranged, further comprising a cover which covers the components, wherein said front panel and said rear panel have on their inner surrounding surfaces leg portions which come into contact with a surface of said cover such that both said panels are held in position while maintaining a space between said cover and both said panels.

* * * * *